US010527341B2

(12) United States Patent
Ungor et al.

(10) Patent No.: US 10,527,341 B2
(45) Date of Patent: Jan. 7, 2020

(54) WATER DRAINAGE ASSEMBLY FOR USE IN A REFRIGERATION APPLIANCE

(71) Applicant: ARCELIK ANONIM SIRKETI, Istanbul (TR)

(72) Inventors: Murat Ungor, Istanbul (TR); Murat Yetilmezsoy, Istanbul (TR); Mustafa Arslan, Istanbul (TR); Husamettin Celik, Istanbul (TR); Salih Pelin, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 398 days.

(21) Appl. No.: 15/306,652

(22) PCT Filed: Apr. 30, 2014

(86) PCT No.: PCT/EP2014/058841
§ 371 (c)(1),
(2) Date: Oct. 25, 2016

(87) PCT Pub. No.: WO2015/165526
PCT Pub. Date: Nov. 5, 2015

(65) Prior Publication Data

US 2017/0045286 A1 Feb. 16, 2017

(51) Int. Cl.
*F25D 21/14* (2006.01)
*F25D 21/00* (2006.01)
(Continued)

(52) U.S. Cl.
CPC ..... *F25D 21/14* (2013.01); *F25D 21/00* (2013.01); *F25D 23/061* (2013.01); *F24F 2013/227* (2013.01); *F25D 2321/14* (2013.01)

(58) Field of Classification Search
CPC .... F25B 21/14; F25B 23/061; F25B 2321/14; F25B 21/00; F25D 21/14; F25D 23/061;
(Continued)

(56) References Cited

U.S. PATENT DOCUMENTS 5,798,142 A 8/1998 Soubeyrand
6,037,572 A 3/2000 Coates et al.

FOREIGN PATENT DOCUMENTS

DE 29715231 U1 12/1998
DE 102007051333 A1 4/2009
(Continued)

OTHER PUBLICATIONS

English Translation of JP2009-197451 (Year: 2009).*
(Continued)

*Primary Examiner* — David J Teitelbaum
(74) *Attorney, Agent, or Firm* — Kilpatrick Townsend & Stockton LLP

(57) ABSTRACT

The present invention relates to a water drainage assembly for use in a refrigeration appliance which has a rear outer wall and a rear inner wall. The water drainage assembly of the present invention comprises a water drainage apparatus which has an upper mounting seat and a lower mounting seat formed on opposing ends of its main body, wherein the lower mounting seat form-fittingly abuts against a vertical planar portion of the rear outer wall, and wherein the upper mounting seat form-fittingly abuts against a curved portion of the rear inner wall.

15 Claims, 8 Drawing Sheets

Figure 1:
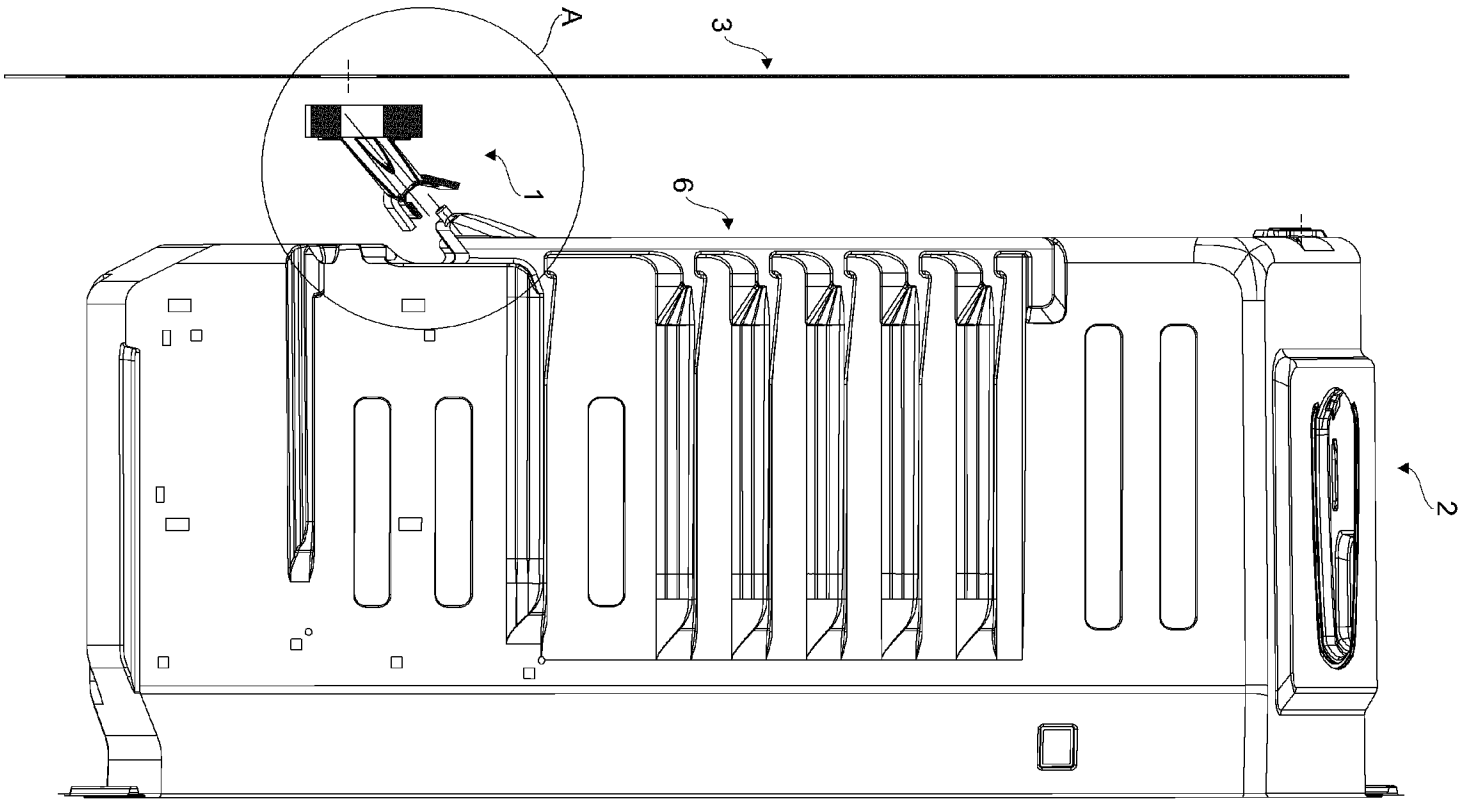

(51) Int. Cl.
*F25D 23/06* (2006.01)
*F24F 13/22* (2006.01)

(58) Field of Classification Search
CPC . F25D 2321/14; F25D 21/00; F24F 2013/227
See application file for complete search history.

(56) References Cited

FOREIGN PATENT DOCUMENTS

| | | | | | |
|---|---|---|---|---|---|
| EP | 2476981 | A2 | | 7/2012 | |
| JP | 2009-197451 | A | * | 9/2009 | ..... E04B 1/64 |
| WO | 2009135148 | A2 | | 11/2009 | |

OTHER PUBLICATIONS

International search report, dated Jan. 23, 2015, of corresponding International Application No. PCT/EP2014/058841; 3 pgs.
Written opinion, dated Jan. 23, 2015, of International Application No. PCT/EP2014/058841; 6 pgs.

* cited by examiner

WATER DRAINAGE ASSEMBLY FOR USE IN A REFRIGERATION APPLIANCE

RELATED APPLICATIONS

This application is a U.S. National Phase of International Application No. PCT/EP2014/058841, filed Apr. 30, 2014, the entire disclosure of which is incorporated by reference herein.

The present invention relates to a water drainage assembly for use in a refrigeration appliance, in particular a domestic refrigerator.

In general, a conventional domestic refrigerator has a water drainage facility for draining defrost water which is formed inside an inner case to an outside. In the conventional domestic refrigerator, the water drainage facility usually has a drainage hose which is mounted to a drainage outlet of the inner case by utilizing silicone hot melt adhesives.

A problem with the assembly process involving the silicone hot melt adhesives is that in the event of using an excessive amount of adhesive silicone, the drainage hose may get clogged, and in the event of using an insufficient mount of adhesive silicone, the junction between the drainage hose and the drainage outlet may have leak.

On the other hand, it is common practice to fill the space between the inner case and an outer case of the refrigeration appliance with foam material to attain an improved thermal insulation of the refrigerating compartment. Thus, in the event of a leak in the aforementioned junction between the drainage hose and the drainage outlet, the curing foam material may easily flow into the drainage hose through the leak and clog the same.

In either of the above-described cases, the water drainage facility will not function properly due to clogging. Thus, the defrost water in the domestic refrigerator starts to leak into the kitchen due to the manufacturing errors. In general, the customer returns such domestic refrigerators to a customer service for inspection. This reduces consumer satisfaction.

EP 2 476 981 A2 discloses a drain hose assembly for use in a refrigerator and a refrigerator having the same.

An objective of the present invention is to provide a water drainage assembly for use in refrigeration appliance and a refrigeration appliance having the same which overcomes the aforementioned drawbacks of the prior art and which enables a cost-effective, easy and reliable assembly process.

This objective have been achieved by the water drainage assembly as defined in claim 1, and the refrigeration appliance as defined in claim 12. Further achievements have been attained by the subject-matters respectively defined in the dependent claims.

In the refrigeration appliance of the present invention, a rear outer wall of the outer case has a vertical planar portion into which an opening is formed. The vertical planar portion extends in a lateral direction which is perpendicular to the lateral outer walls of the outer case. In the refrigeration appliance of the present invention, a rear inner wall of the inner case has a curved portion into which the drainage outlet is formed. The curved portion extends straight along said lateral direction. The opening lies lower than the drainage outlet.

The water drainage assembly of the present invention comprises a water drainage apparatus which has an upper mounting seat and a lower mounting seat which are formed on opposing ends of a main body thereof. The lower mounting seat form-fittingly abuts against the vertical planar portion. The upper mounting seat form-fittingly abuts against the curved portion. The water drainage apparatus further comprises an inclined channel formed into the main body so as to fluidly connect the opening with the drainage outlet. The water drainage assembly further comprises a plurality of bonding tapes for sealing an interface between the vertical planar portion and the lower mounting seat and an interface between the curved portion and the upper mounting seat respectively.

In an embodiment, the water drainage assembly comprises a double-sided first bonding tape which is to be arranged between a lower mounting seat and the vertical planar portion so as to bond them together. The first bonding tape has a through-hole for allowing throughflow of drainage water.

In another embodiment, the water drainage assembly comprises a double-sided second bonding tape to be arranged between an inner surface of the upper mounting seat and the curved portion to bond them together. The second bonding tape has a through-hole or cut portion for allowing throughflow of drainage water.

In another embodiment, the water drainage assembly comprises a single-sided third bonding tape to be arranged on a rear surface of the upper mounting seat and on a periphery of the curved portion to bond them together. The single-sided third bonding tape has a cut portion to encompass the body of the water drainage apparatus.

In another embodiment, the water drainage assembly comprises in addition to the single-sided third bonding tape, a double-sided fourth bonding tape to be arranged between a lower part of the inner surface of the upper mounting seat and the curved portion to bond them together. The fourth bonding tape partly overlaps in a stacking direction the third bonding tape including a cut portion thereof.

In an embodiment, the refrigeration appliance comprises cured foam material that encloses the water drainage assembly.

By virtue of the upper mounting seat and the lower mounting seating, the water drainage apparatus can be stably abutted against the vertical planar portion and the curved portions and simultaneously fixed to its designated position by utilizing the bonding tapes which also seal the interfaces to prevent intrusion of curing foam material. By the present invention the use of silicone hot melt adhesive has been obviated. Thereby, a risk of clogging of the drainage outlet or any other component parts has been eliminated. The overall rate of waste production and manufacturing errors has been effectively reduced. The water drainage assembly of the present invention is cost-effective and easy to install.

Figure 2:
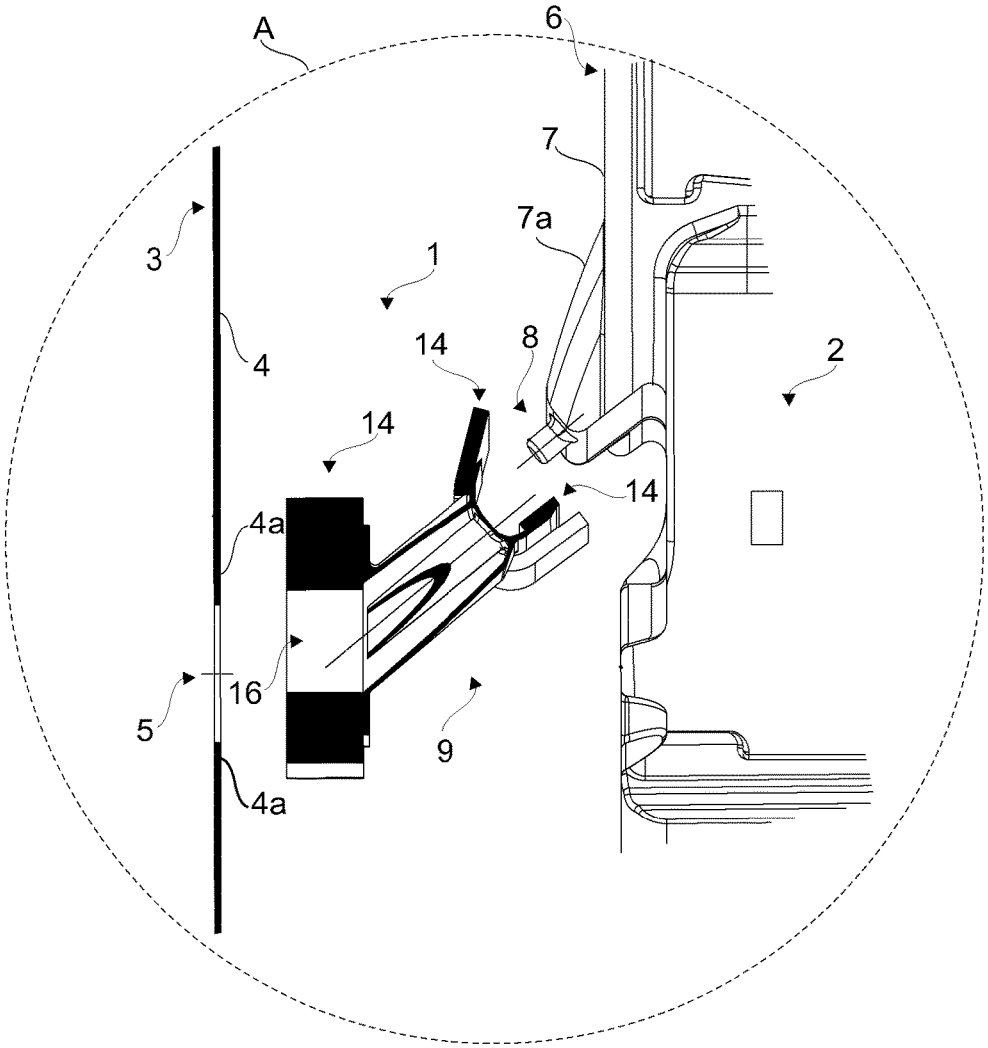
Figure 3:
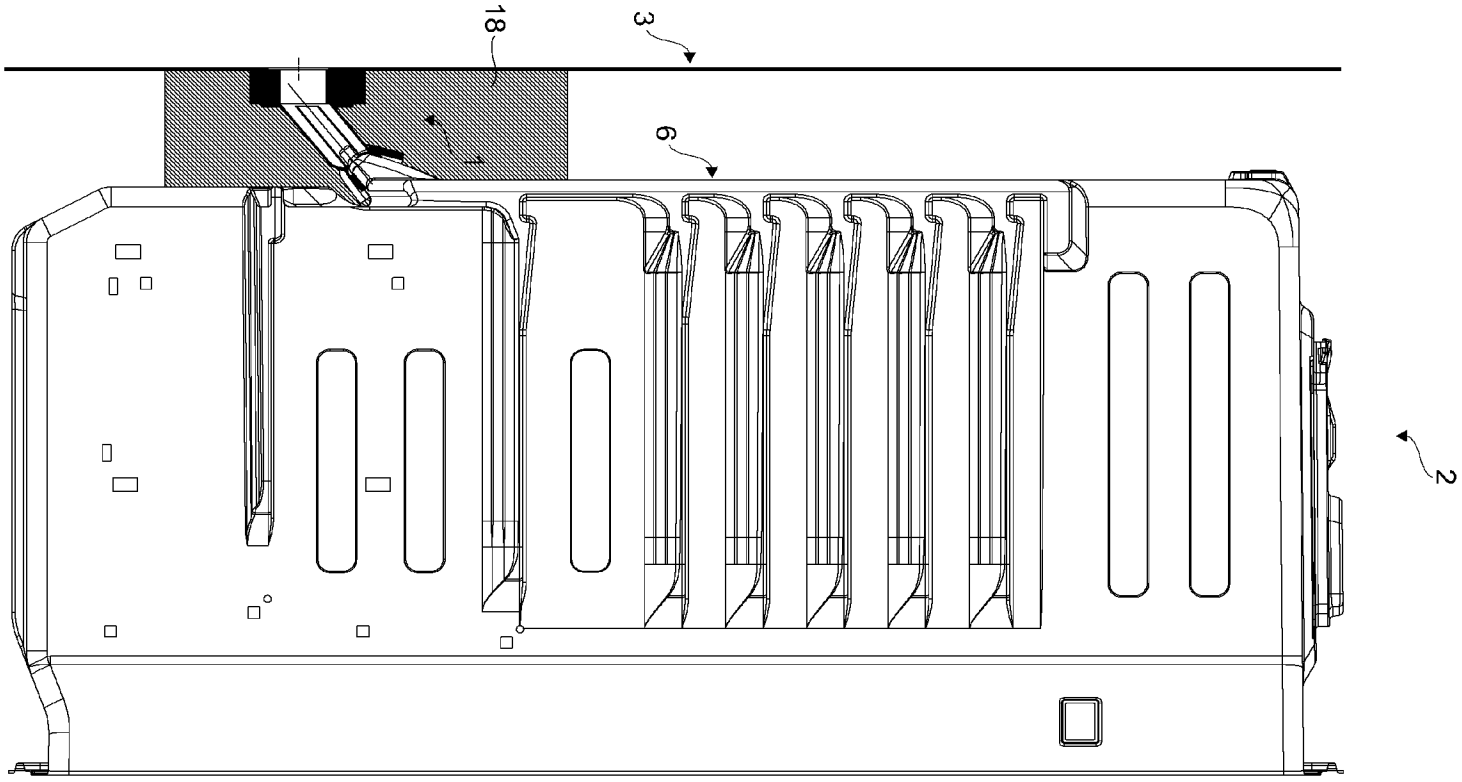
Figure 4:
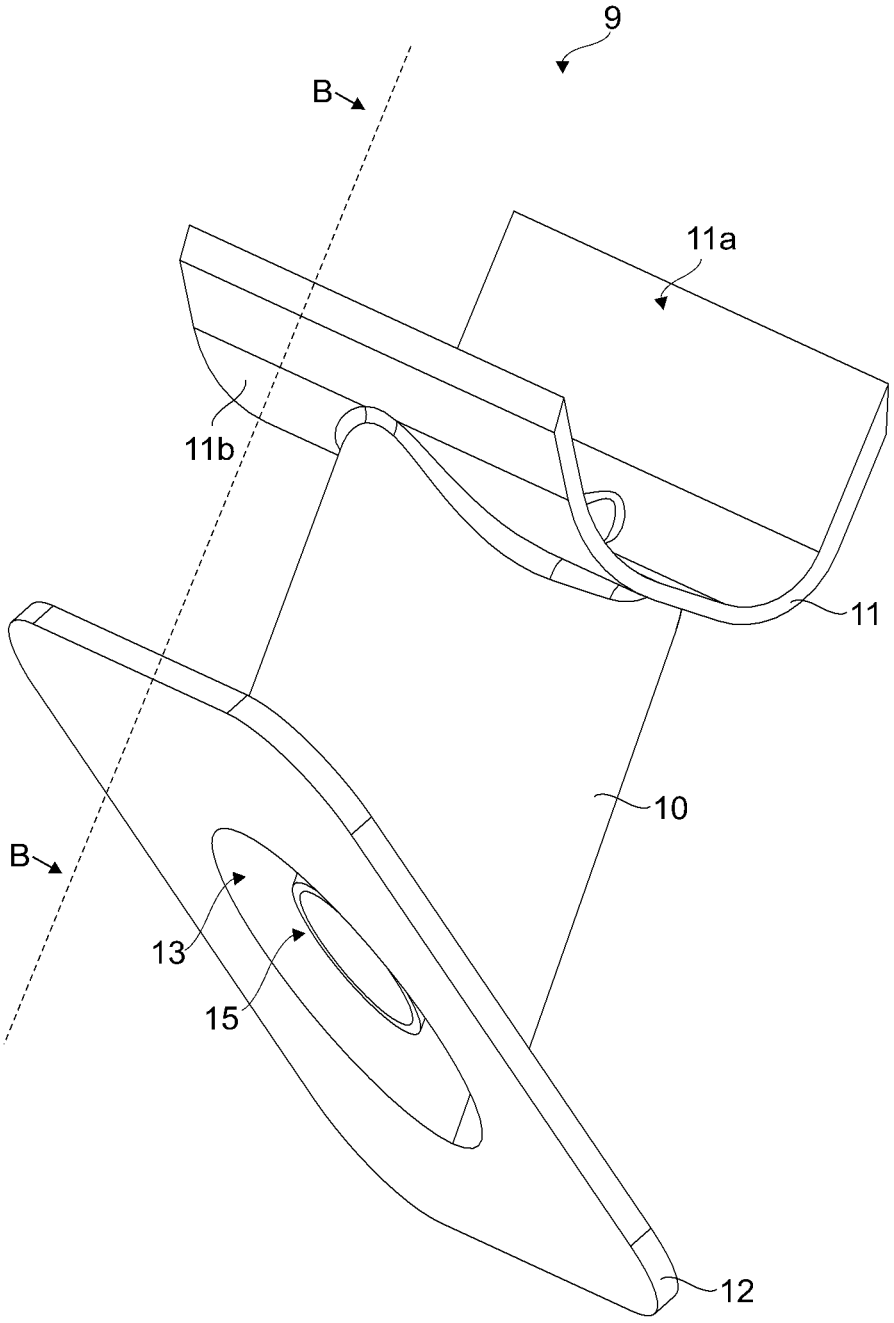
Figure 5:
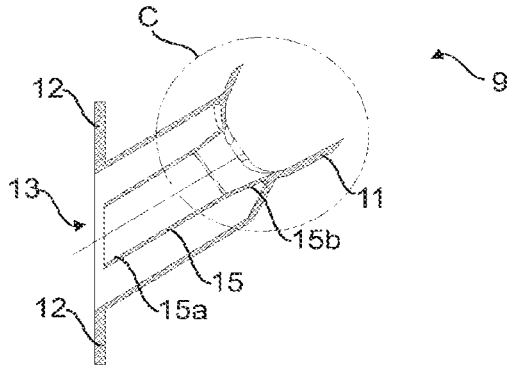
Figure 6:
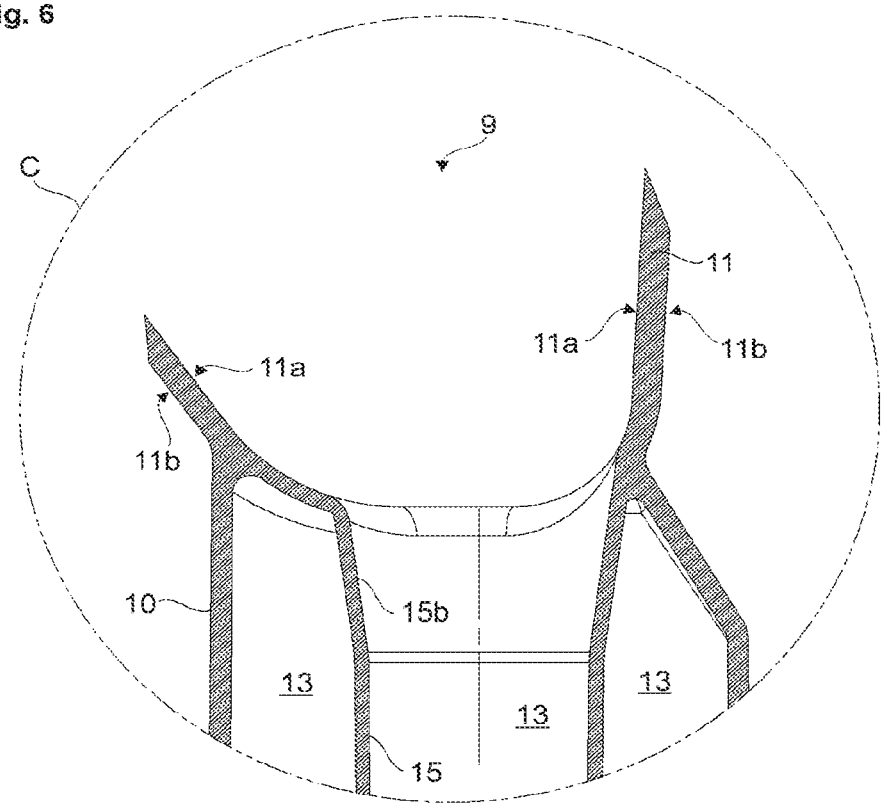
Figure 7:
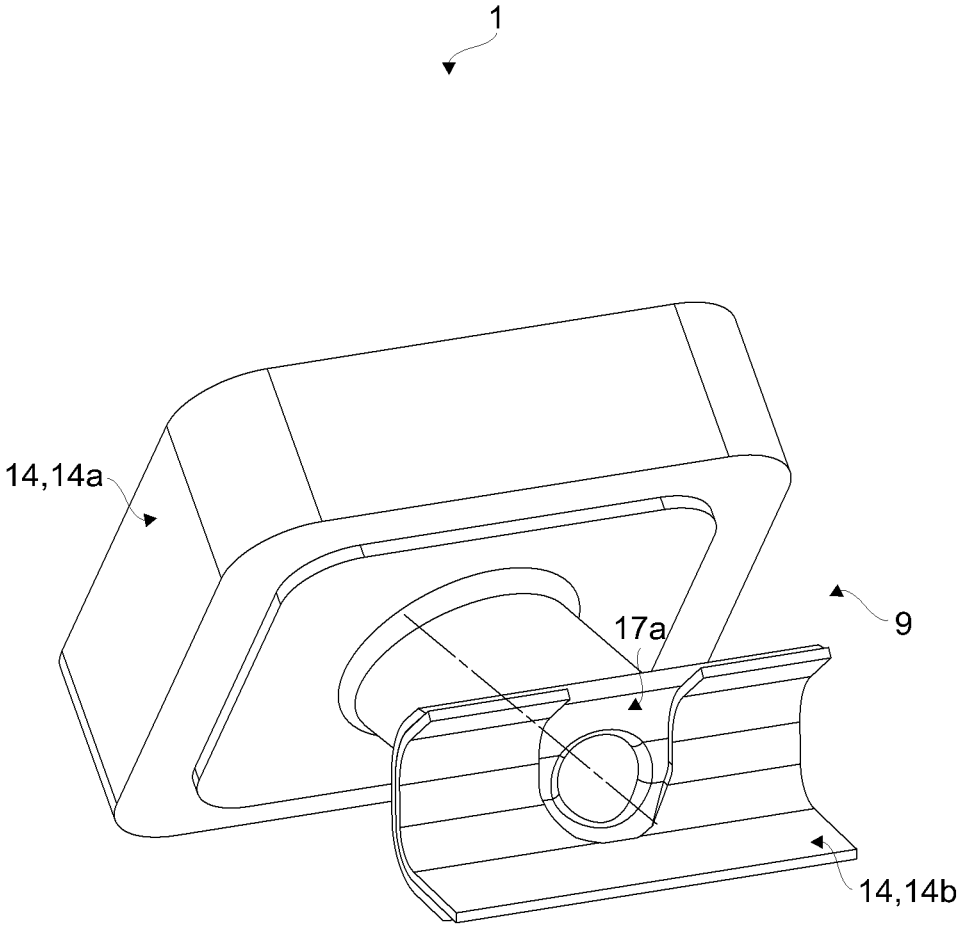
Figure 8:
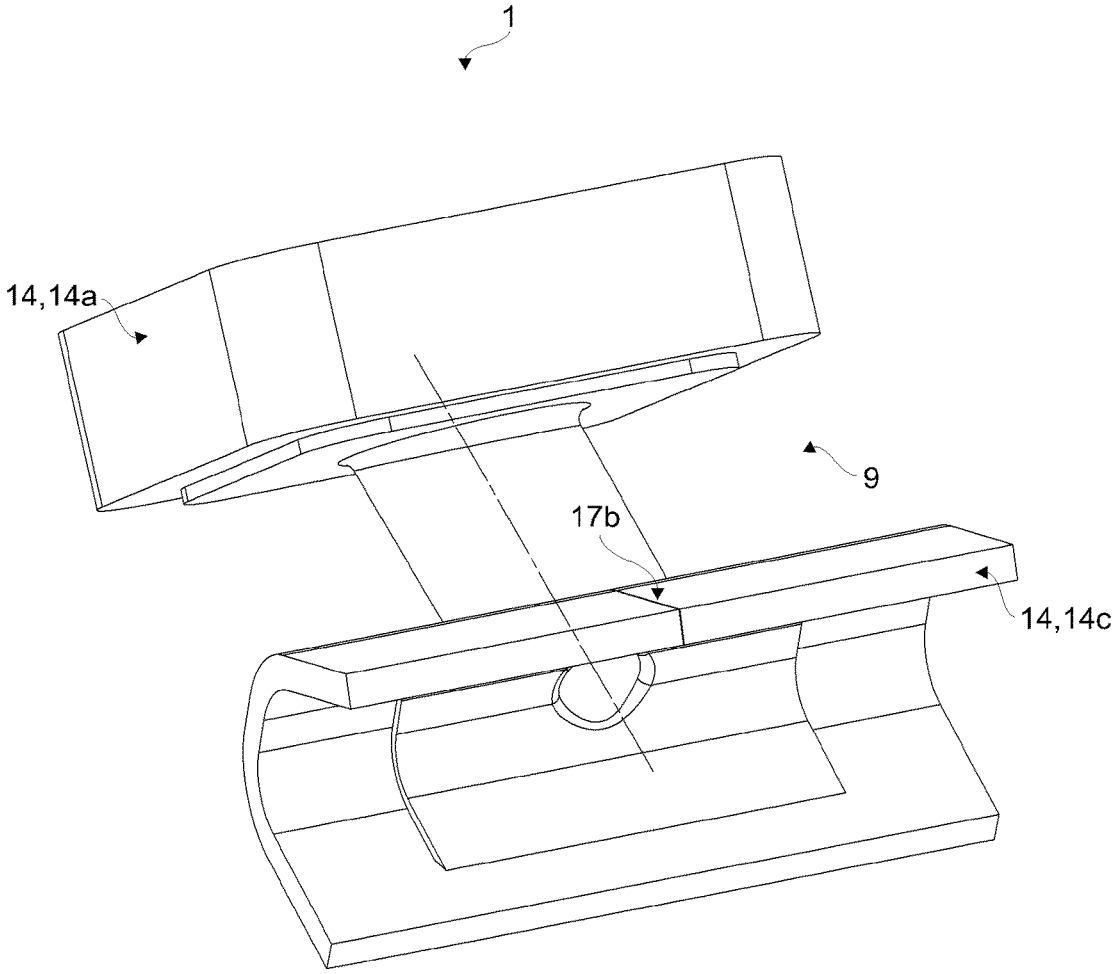
Figure 9:
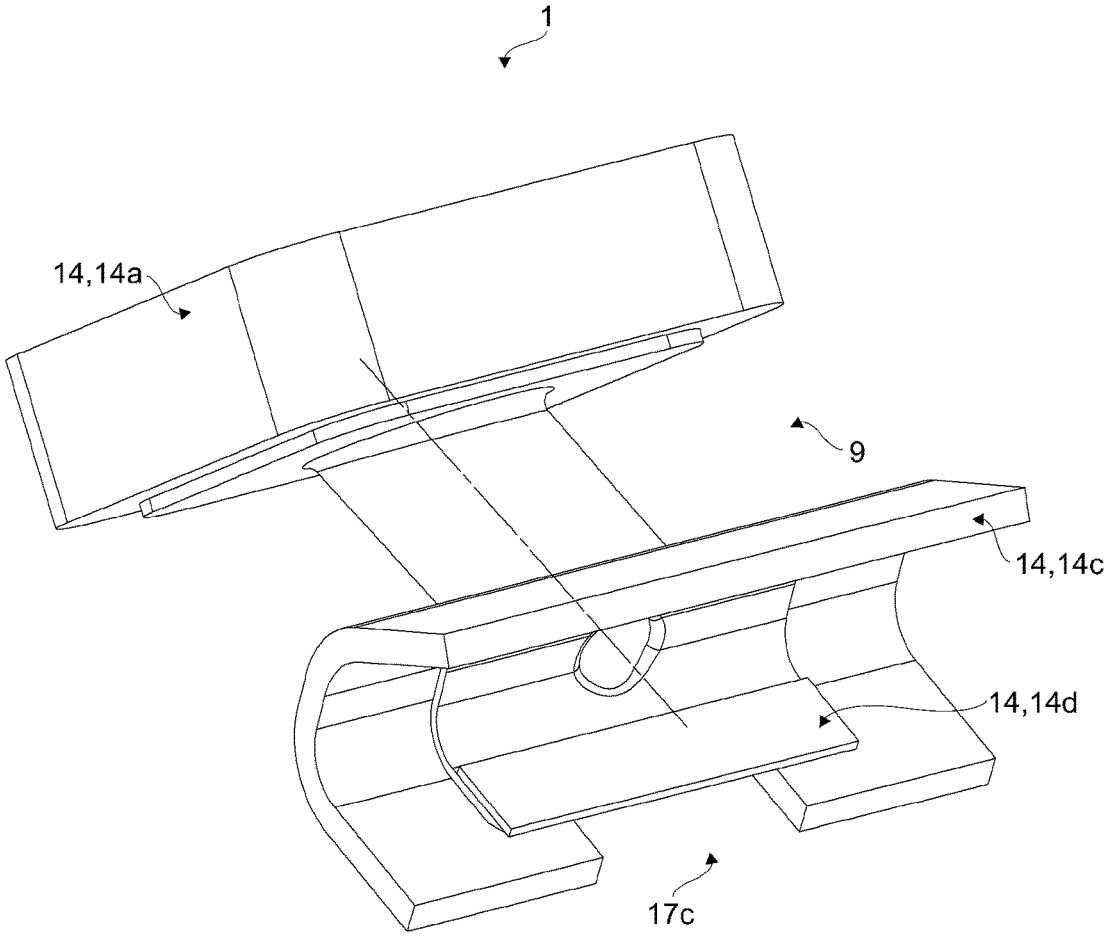

Additional advantages of the water drainage assembly of the present invention and the refrigeration appliance of the present invention will become apparent with the detailed description of the embodiments with reference to the accompanying drawings in which:

FIG. 1—is a schematic exploded partial perspective side view of a refrigeration appliance having the water drainage assembly according to an embodiment of the present invention;

FIG. 2—is a schematic enlarged view of the detail A of FIG. 1;

FIG. 3—is a schematic vertical cross sectional partial view of the refrigeration appliance having the water drainage assembly according to an embodiment of the present invention;

FIG. 4—is a schematic perspective view of a water drainage apparatus of the water drainage assembly according to an embodiment of the present invention;

FIG. 5—is a schematic vertical cross sectional view of the water drainage apparatus of FIG. 4, take along the line B-B;

FIG. 6—is a schematic enlarged view of the detail C of FIG. 5;

FIG. 7—is a schematic perspective view of the water drainage assembly according to an embodiment of the present invention;

FIG. 8—is a schematic perspective view of the water drainage assembly according to another embodiment of the present invention;

FIG. 9—is a schematic perspective view of the water drainage assembly according to another embodiment of the present invention.

The reference signs appearing on the drawings relate to the following technical features.

1. Water drainage assembly
2. Refrigeration appliance
3. Outer case
4. Rear outer wall
4*a*. Planar portion
5. Opening
6. Inner case
7. Rear inner wall
7*a*. Curved portion
8. Drainage outlet
9. Water drainage apparatus
10. Main body
11. Upper mounting seat
11*a*. Inner surface
11*b*. Rear surface
12. Lower mounting seat
13. Channel
14. Bonding tapes
14*a*. First bonding tape
14*b*. Second bonding tape
14*c*. Third bonding tape
14*d*. Fourth bonding tape
15. Conduit
15*a*. Lower end
15*b*. Upper end
16. Through-hole
17*a*. Cut portion
17*b*. Cut portion
17*c*. Cut portion
18. Foam material The water drainage assembly (1) is suitable for use in a refrigeration appliance (2), in particular a domestic refrigerator (FIGS. 1 to 3).

The refrigeration appliance (2) comprises an outer case (3) and an inner case (6). The outer case (3) comprises two mutually opposing lateral outer walls (not shown) and a rear outer wall (4). The inner case (6) comprises a rear inner wall (7) and a drainage outlet (8) (FIGS. 1 to 3).

The refrigeration appliance (2) of the present invention comprises an opening (5) which is formed into a vertical planar portion (4*a*) of the rear outer wall (4). The vertical planar portion (4*a*) extends in a lateral direction which is perpendicular to the lateral outer walls. The drainage outlet (8) is formed into a curved portion (7*a*) of the rear inner wall (7). The curved portion (7*a*) extends straight along said lateral direction. The opening (5) lies lower than the drainage outlet (8). The refrigeration appliance (2) of the present invention further comprises a water drainage assembly (1) which is mounted between the vertical planar portion (4*a*) and curved portion (7*a*) (FIGS. 1 to 3).

The water drainage assembly (1) of the present invention comprises a water drainage apparatus (9) which includes a main body (10) having an upper mounting seat (11) and a lower mounting seat (12) which are formed on opposing ends of the main body (10). The lower mounting seat (12) is configured to form-fittingly abut against the vertical planar portion (4*a*) whereas the upper mounting seat (11) is configured to form-fittingly abut against the curved portion (7*a*). An inclined channel (13) is formed into the main body (10). The channel (13) is configured to fluidly connect the opening (5) with the drainage outlet (8). The water drainage assembly (1) of the present invention further comprises a plurality of bonding tapes (14) for sealing an interface between the vertical planar portion (4*a*) and the lower mounting seat (12), and an interface between the curved portion (7*a*) and the upper mounting seat (11) respectively (FIGS. 1 to 9).

In an embodiment, the refrigeration appliance (2) comprises cured foam material (18) between the rear outer wall (4) and the rear inner wall (7). The foam material (18) encloses the water drainage assembly (1) (FIG. 3).

In another embodiment, a conduit (15) is provided inside the channel (13). The conduit (15) has a lower end (15*a*) and an upper end (15*b*). The lower end (15*a*) of the conduit (15) is configured to attach to a drainage-hose (not shown) whereas an upper end (15*b*) of the conduit (15) is configured to allow the drainage outlet (8) to penetrate into the conduit (15) (FIGS. 4 to 6).

In another embodiment, the conduit (15) is coaxially provided inside the channel (13) (FIG. 5).

In another embodiment, the bonding tapes (14) include a double-sided first bonding tape (14*a*) which is provided with a through-hole (16). The double-sided first bonding tape (14*a*) has a size and shape which is configured to adhere to the lower mounting seat (12) and to the vertical planar portion (4*a*). In a bonded state, the channel (13) fluidly connects the opening (5) with the drainage outlet (8) through said through-hole (16) (FIGS. 7 to 9).

In another embodiment, the bonding tapes (14) further include a double-sided second bonding tape (14*b*) which has a cut portion (17*a*) defining a fluid passage. The double-sided second bonding tape (14*b*) has a size and shape which is configured to adhere to an inner surface (11*a*) of the upper mounting seat (11) and to the curved portion (7*a*). In a bonded state, the channel (13) fluidly connects the opening (5) with the drainage outlet (8) through said fluid passage (FIG. 7).

In another embodiment, the bonding tapes (14) further include a single-sided third bonding tape (14*c*). The single-sided third bonding tape (14*c*) has a size and shape which is configured to adhere to a rear surface (11*b*) of the upper mounting seat (11) and to a periphery of the curved portion (7*a*). The single-sided third bonding tape (14*c*) has a cut portion (17*b*, 17*c*) to enable penetration of the main body (10) (FIG. 8).

In a version of this embodiment, the cut portion (17*b*) is formed at an upper mid portion of the single-sided third bonding tape (14*c*) (FIG. 8).

In another embodiment, the bonding tapes (14) further include a double-sided fourth bonding tape (14*d*). The double-sided fourth bonding tape (14*d*) has a size and shape which is configured to adhere to a lower part of the inner surface (11*a*) of the upper mounting seat (11). The cut portion (17*c*) is formed at a lower mid portion of the single-sided third bonding tape (14*c*) so as to partly oppose the double-sided fourth bonding tape (14*d*). In a version of this embodiment, a width of the double-sided fourth bonding tape (14*d*) is equal to a width of the upper mounting seat (11). The width extends in lateral direction (FIG. 9).

In another embodiment, the double-sided first bonding tape (14*a*) is thicker than each of the second to fourth bonding tapes (14*b*-14*d*) (FIGS. 7 to 9).

In another embodiment, the second to fourth bonding tapes (14*b*-14*d*) each have a thickness of 5 mm.

In another embodiment, the bonding tapes (14) each include a sponge layer having a uniform thickness (FIGS. 7 to 9).

By virtue of the upper mounting seat (11) and the lower mounting seating (12), the water drainage apparatus (9) can be stably positioned between the vertical planar portion (4*a*) and the curved portion (7*a*) and secured by utilizing the bonding tapes (14) which also seal the interfaces to prevent intrusion of curing foam material (18). Due to the stable posture of the water drainage apparatus (9), the curing foam material (18) cannot dislodge the same out of its position. Thus, the interfaces remain leak-tight. Thereby, a risk of clogging of the drainage outlet (8) or any other component parts by the foam material has been eliminated. The water drainage assembly (1) of the present invention is cost-effective and can be easily and reliably installed. By the water drainage assembly (1) of the present invention, the overall rate of waste production and manufacturing errors has been effectively reduced (FIGS. 1 to 9).

The invention claimed is:

1. A water drainage assembly for use in a refrigeration appliance comprising:

an outer case which includes two mutually opposing lateral outer walls, a rear outer wall and an opening which is formed into a vertical planar portion of the rear outer wall, wherein the vertical planar portion extends along a lateral direction which is perpendicular to the lateral outer walls;

an inner case which includes a rear inner wall and a drainage outlet which is formed into a curved portion of the rear inner wall, wherein the curved portion extends straight along said lateral direction, and wherein the opening lies lower than the drainage outlet;

a water drainage apparatus which includes a main body, an upper mounting seat and a lower mounting seat which are formed on opposing ends of the main body, wherein the lower mounting seat is configured to form-fittingly abut against the vertical planar portion, and wherein the upper mounting seat is configured to form-fittingly abut against the curved portion and an inclined channel which is formed into the main body, wherein the channel is configured to fluidly connect the opening with the drainage outlet;

a plurality of bonding tapes including a double-sided first bonding tape provided with a through-hole for sealing a first interface between the vertical planar portion and the lower mounting seat; and a double-sided second bonding tape which has a cut portion defining a fluid passage for sealing a second interface between the curved portion and an inner surface of the upper mounting seat.

2. The water drainage assembly according to claim 1, wherein a conduit is provided inside the channel, wherein a lower end of the conduit is configured to attach to a hose, and an upper end of the conduit is configured to allow the drainage outlet to penetrate into the conduit.

3. The water drainage assembly according to claim 2, wherein an entire length of the conduit is coaxially provided inside the channel.

4. The water drainage assembly according to claim 1, wherein the double-sided first bonding tape has a size and shape which is configured to adhere to the lower mounting seat and to the vertical planar portion such that the channel fluidly connects the opening with the drainage outlet through said through-hole.

5. The water drainage assembly according to claim 4, wherein the double-sided second bonding tape has a size and shape which is configured to adhere to an inner surface of the upper mounting seat and to the curved portion such that the channel fluidly connects the opening with the drainage outlet through said fluid passage.

6. The water drainage assembly according to claim 4, wherein the bonding tapes further include a single-sided third bonding tape which has a size and shape which is configured to adhere to a rear surface of the upper mounting seat and to a periphery of the curved portion, wherein the single-sided third bonding tape has a cut portion to enable penetration of the main body.

7. The water drainage assembly according to claim 6, wherein the cut portion is formed at an upper mid portion of the single-sided third bonding tape.

8. The water drainage assembly according to claim 6, wherein the bonding tapes further include a double-sided fourth bonding tape which has a size and shape which is configured to adhere to a lower part of the inner surface of the upper mounting seat, wherein the cut portion is formed at a lower mid portion of the single-sided third bonding tape so as to oppose the double-sided fourth bonding tape.

9. The water drainage assembly according to claim 8, wherein the double-sided first bonding tape is thicker than each of the second to fourth bonding tapes.

10. The water drainage assembly according to claim 9, wherein the second to fourth bonding tapes each have a thickness about 5 mm.

11. The water drainage assembly according to claim 8, wherein the bonding tapes each include a sponge layer having a uniform thickness.

12. A refrigeration appliance comprising:

an outer case which includes two mutually opposing lateral outer walls, and a rear outer wall, an inner case which includes a rear inner wall and a drainage outlet, an opening formed into a vertical planar portion of the rear outer wall, wherein the vertical planar portion extends in a lateral direction which is perpendicular to the lateral outer walls, wherein the drainage outlet is formed into a curved portion of the rear inner wall, wherein the curved portion extends straight along said lateral direction, wherein the opening lies lower than the drainage outlet, and a water drainage assembly as defined in claim 1, which is mounted between the vertical planar portion and curved portion.

13. The refrigeration appliance according to claim 12, wherein foam material is formed between the rear outer wall and the rear inner wall, wherein the foam material encloses the water drainage assembly.

14. The water drainage assembly according to claim 1, wherein the plurality of bonding tapes each include a sponge layer having a uniform thickness.

15. The water drainage assembly according to claim 2, wherein an outlet of the lower end of the conduit is parallel to the vertical planar portion.

* * * * *